US011639538B2

(12) United States Patent
Zhang et al.

(10) Patent No.: US 11,639,538 B2
(45) Date of Patent: May 2, 2023

(54) DEVICE AND METHOD FOR MANUFACTURING METAL CLAD PLATES IN WAY OF CONTINUOUS CASTING AND ROLLING

(71) Applicant: BAOSHAN IRON & STEEL CO., LTD., Shanghai (CN)

(72) Inventors: Qingfeng Zhang, Shanghai (CN); Sihai Jiao, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 52 days.

(21) Appl. No.: 17/253,899

(22) PCT Filed: Jan. 14, 2019

(86) PCT No.: PCT/CN2019/071592
§ 371 (c)(1),
(2) Date: Dec. 18, 2020

(87) PCT Pub. No.: WO2020/001004
PCT Pub. Date: Jan. 2, 2020

(65) Prior Publication Data

US 2021/0262057 A1 Aug. 26, 2021

(30) Foreign Application Priority Data

Jun. 29, 2018 (CN) ..... 201810702350.0

(51) Int. Cl.
*C21D 9/60* (2006.01)
*B21B 1/24* (2006.01)
(Continued)

(52) U.S. Cl.
CPC ..... *C21D 9/60* (2013.01); *B21B 1/24* (2013.01); *B22D 11/1206* (2013.01);
(Continued)

(58) Field of Classification Search
None
See application file for complete search history.

(56) References Cited

U.S. PATENT DOCUMENTS 5,554,235 A * 9/1996 Noe ..... C21D 8/0205 29/81.08
5,752,563 A 5/1998 Ollman
(Continued)

FOREIGN PATENT DOCUMENTS

CN 1141962 A 2/1997
CN 1714957 A 1/2006
(Continued)

OTHER PUBLICATIONS

Machine Translation of JPS6149748A (Year: 1986).*
Machine Translation of JPS62214887A (Year: 1987).*

*Primary Examiner* — Kevin E Yoon
*Assistant Examiner* — Ryan L Heckman
(74) *Attorney, Agent, or Firm* — Rothwell, Figg, Ernst & Manbeck, P.C.

(57) ABSTRACT

The device and method for manufacturing metal clad plates in way of continuous casting and rolling provided by the present invention, combines the continuous casting, rolling and heat treatment methods used for single material production with the continuous and large-scale production method of composite strip, greatly improves the production efficiency of composite plates. The present invention can be used for producing single-sided or double-sided composite plates with different thickness specifications, wherein the base material or the composited material can be selected in a wide range, including carbon steel, stainless steel, special alloy steel, titanium, copper and the like. The invention realizes the production of composite plates by continuous casting and rolling, and reduces energy consumption and costs.

5 Claims, 1 Drawing Sheet

Figure 1:
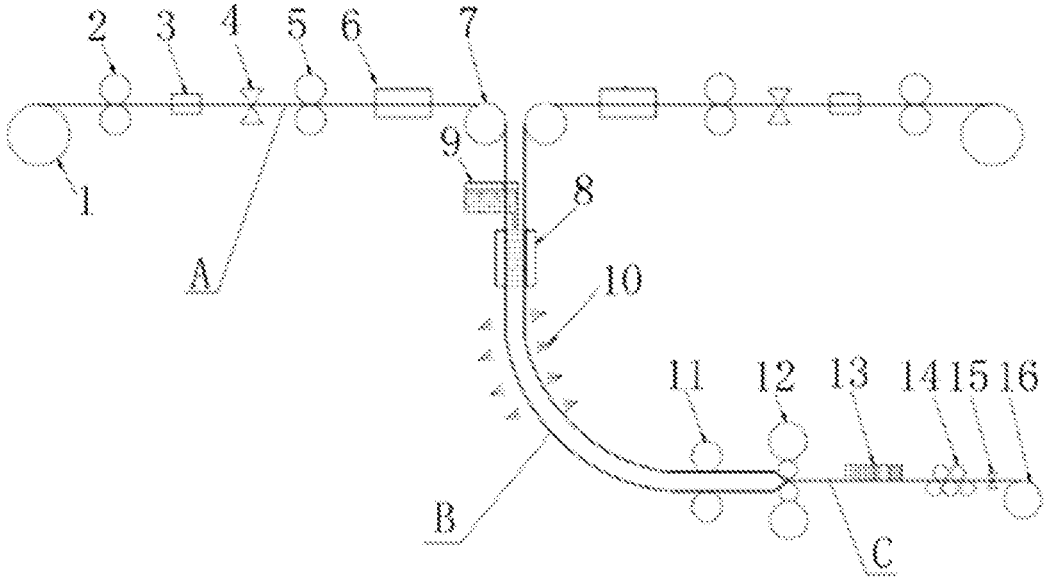

(51) Int. Cl.

| | |
|---|---|
| ***B22D 11/12*** | (2006.01) |
| ***B22D 11/126*** | (2006.01) |
| ***C21D 1/42*** | (2006.01) |
| ***C21D 8/02*** | (2006.01) |
| ***C21D 9/50*** | (2006.01) |
| ***C21D 9/56*** | (2006.01) |

(52) U.S. Cl.
CPC ..... *B22D 11/126* (2013.01); *B22D 11/1226* (2013.01); *C21D 1/42* (2013.01); *C21D 8/0205* (2013.01); *C21D 8/0226* (2013.01); *C21D 9/50* (2013.01); *C21D 9/561* (2013.01)

(56) References Cited

U.S. PATENT DOCUMENTS 5,964,114 A * 10/1999 Noe ..... B21B 37/28 72/9.1
5,990,464 A * 11/1999 Hino ..... B21B 1/26 219/602

FOREIGN PATENT DOCUMENTS

| | | | | | |
|---|---|---|---|---|---|
| CN | 102039309 | A | | 5/2011 | |
| CN | 101780532 | A | | 10/2012 | |
| CN | 102941325 | A | | 2/2013 | |
| CN | 103495618 | A | | 1/2014 | |
| CN | 103658178 | A | | 3/2014 | |
| CN | 104249135 | A | | 12/2014 | |
| CN | 104525566 | A | | 4/2015 | |
| CN | 105215307 | A | | 1/2016 | |
| CN | PCT/CN2019/071592 | A | | 4/2019 | |
| CN | 201810702350.0 | A | | 1/2020 | |
| CN | 2018107023500 | A | | 1/2020 | |
| JP | 51111458 | A | | 10/1976 | |
| JP | 59156538 | A | | 9/1984 | |
| JP | S6149748 | A | | 3/1986 | |
| JP | S6149748 | A | * | 3/1986 | ..... B22D 11/008 |
| JP | S61135461 | A | | 6/1986 | |
| JP | S61172655 | A | | 8/1986 | |
| JP | 61286044 | A | | 12/1986 | |
| JP | S62214887 | A | * | 9/1987 | ..... B23K 20/04 |
| JP | 09271901 | A | | 10/1997 | |

* cited by examiner

DEVICE AND METHOD FOR MANUFACTURING METAL CLAD PLATES IN WAY OF CONTINUOUS CASTING AND ROLLING

TECHNICAL FIELD

The invention relates to steel metallurgical production, in particular to a device and method for manufacturing metal clad plates in way of continuous casting and rolling, which can be used to produce metal clad plates combined with different materials.

BACKGROUND ARTS

With the development of modern technology and national economy, customers have stricter requirements on the performance of materials. Since a single metal material can hardly satisfy the requirements for multiple performance in practical use, metal composite material that can provide both functional and structural performance arises, which becomes important in meeting the needs of customization and becomes more and more widely known and used by the customers. Some common devices and methods for manufacturing a metal composite strip are listed as below:

1. Explosive cladding: Clean up the contact surfaces of two different metallic materials and add explosive into the interface between them. Using the instant high temperature caused by explosion, the materials can be welded together. The composite strip made by this method bonds insufficiently and its composite strength is low, which is only suitable for single sheet and small batch production;
2. Roll-bonded cladding: Clean the surface of stainless steel and carbon steel for composite, align them, vacuum the surrounding area and weld, then heat and roll to complete composite. The composite strip made by this method bonds sufficiently and its composite strength is high, but the low production efficiency makes this method only suitable for single sheet and small batch production;
3. Centrifugal casted cladding: The molten carbon steel and the molten stainless steel are sequentially added to the centrifuge. The molten carbon steel and the molten stainless steel are solidified successively to form an annular composite pipe. Then the straightening, heating, rolling and other processes are carried out.

Roll-bonded cladding is currently an ideal compositing process. The composite strip produced by this process has complete metallurgical bonding at the interface, high composite strength, and excellent product performance, but the efficiency of billet assembly is low. The billet assembly process includes multiple processes. It is difficult to realize continuous, automated and large-scale production, so the cost is high. In recent years, In recent years, some processes and methods for continuous production of clad plates have emerged, such as composite plate produced by continuous casting and rolling, thin strip continuous casting, etc. For example, CN1714957A discloses a method and equipment for producing composite plates or strips of different metal materials. The continuous casting and rolling of single-sided or double-sided composite plates or strips with different metallic materials is achieved by using 2-3 moulds for molten carbon steel and stainless steel on the same continuous casting machine. The mould consists of four steel strips at the top, bottom, left and right sides that perform cyclic movement simultaneously, changing the form of mould from the past. The base layer metal and the composited layer metal is formed by the solidification of the liquid metal in the mould.

CN101780532A discloses a method for continuous casting of a liquid-phase composite slab. The base metal melt and the composite metal melt are injected separately into a roll type crystallizer molten pool formed by crystallizing rolls and side seal plates. An intermediate diaphragm separates the molten pool into a base material dissolved cavity and a composite material dissolved cavity. The composite slab formed in the mould is then leveled and cut to length. The disadvantage is that as the composited layer and the base layer are formed by the solidification of molten steel at the same time, it is difficult to control the bonding, which requires to keep the two types of molten steel from mixing and to ensure that the two materials can be bonded at an appropriate temperature.

CN104249135A discloses a method for preparing double roller thin strips of a composite strip. An intermediate strip is sent to the molten pool for continuous casting of double roller thin strips. The molten metal is solidified rapidly under the cooling action of the crystallizing roller and the intermediate strip to form single-sided or double-sided composite strip. Similarly, CN103495618A discloses a device and method for manufacturing metal clad plates by casting and rolling. The base material to be composited is sent to the molten pool of a thin strip continuous casting machine and the molten metal to be composited in the molten pool is solidified on the surface of the base material. After secondary cooling, leveling and rolling, a composite strip is produced. As both methods are based on the technique of continuous casting of a thin strip, the products prepared are mainly thin strips, and the thickness of the solidified composite layer is limited, which makes it not suitable for preparing composite strips with thick composite layers.

CN102039309A discloses a method for continuous casting and rolling of a twin-roller double-strip composite-structured thin strip. Two base material strips surround the crystallizing roller to form a molten pool. The metal solution in the molten pool is solidified and then formed into a composite casting strip with the two metal base material strips. After being rolled by a roller, a composite strip is formed. In this method, the composite metal layer is formed by steel strips and the base layer is formed by solidification of molten steel.

CN105215307A discloses production technology and production equipment for a double-layer composite plate. Two tundishes and two moulds are used to produce a composite plate by solidification of different materials in succession. The cast slab solidified in the first mould enters the second mould, so that the second material can be attached to the surface for solidification. A single-sided composite plate is then produced after secondary cooling, rolling and other working procedures.

CN1141962A discloses a reversal-fixation method for continuous production of a composite stripe. After uncoiled, descaled and passivized, the base material strip is preheated at a temperature between 200~1000° C. and enters crystallization tank to conduct continuous compounding with the molten metal in the tank.

The patents mentioned above are new techniques developed to improve the production efficiency of composite plates and achieve continuous production while each has some disadvantages.

SUMMARY OF THE INVENTION

The present invention provides a device and method for manufacturing metal clad plates in way of continuous casting and rolling, which can improve the production efficiency of composite plates and reduce production costs.

A device and method for manufacturing metal clad plates in way of continuous casting and rolling according to the present invention, the device and specific steps are as follows:

A device for manufacturing metal clad plates in way of continuous casting and rolling, comprising base material supplying equipment consisting of uncoiler (1), pinch roller (2), shot blasting machine (3), welding equipment (4), welding pinch roller (5), induction heating apparatus (6), and guiding roller (7), the device comprises two base material supplying equipment lines, two base material strips (A) are transported through uncoiler (1), pinch roller (2), shot blasting machine (3), welding equipment (4), welding pinch roller (5), induction heating apparatus (6) and guiding roller (7) at different lines, to mould (8) where base material and molten steel are merged; the base material strip enters the mould from above and passes through from below along the inner walls of two sides of the mould, wherein the two inner walls of the mould being sealed with side seal plates; a tundish (9) for casting molten steel is provided above the mould; the molten steel flows from the tundish into the mould and comes into contact with the base material strip in the mould, so that a preliminary melt merging takes place;

upon preliminary melt merging, the base material strip (A) forms a composite slab (B) and passes through the mould from below, and is cooled at a secondary cooling section (10) with cooling-spray located at the outlet of the lower part the mould; a ski pass roll (11) is provided after the secondary cooling section, and after the ski pass roll provided is a rolling mill (12) for making the composite slabs into composite strips (C) with different size and specification; an on-line cooling equipment (13) for the composite strips is provided after the rolling mill, a leveler (14) is provided at the exit of the on-line cooling equipment; the leveled composite strip is then cut to fixed length by a cut-to-length shear (15) or is coiled by a coiler (16).

A method for manufacturing metal clad plates in way of continuous casting and rolling by using the said device for manufacturing metal clad plates in way of continuous casting and rolling, comprising the following steps:

1) uncoiling base material strip (A) having a thickness of 2-25 mm with uncoiler (1) and sending it with pinch roller (2) to shot blasting machine (3) for surface cleaning;

while sending base material strip having a thickness of 26-100 mm directly to the shot blasting machine (3) by pinch roller (2) for surface cleaning; then welding the shot-blasted base material strips by head-to-tail with welding equipment (4) so as to achieve continuous supply of base material strip;

2) sending the welded base material strip with welding pinch roller (5) to induction heating apparatus (6) for heating, wherein the induction heating apparatus is filled with nitrogen or argon protection atmosphere, the heating temperature is 100° C. to 1200° C., the heating rate ranges from 1-50° C./s depending on the thickness of the strip; the base material strip is selected from carbon steel, stainless steel, special alloy steel, titanium, copper and other metals, the heating is to make the base material strip and the base metal melt in the subsequent step easier to merge, and accelerate the surface metal of the base material to melt;

3) through guiding roller (7), the heated base material strip is transported to mould (8) at a rate of 0.1-30 m/min, the base material strip enters into the mould from above and passes through from below along the inner walls of two sides of the mould at a rate of 0.1~30 m/min kept unchanged; meanwhile, the base metal melt flows from the tundish (9) into the mould with argon blowing on its surface to prevent the base metal melt from oxidation; the temperature of the base metal melt is 30~150° C. higher than the melting point of the base material strip, and the base metal melt is selected from carbon steel, stainless steel, special alloy steel, titanium, and copper;

the base metal melt having high temperature contacts with the surface of the base material strip having low temperature, leading to slightly melt on the surface of the base material strip, and the base metal melt is solidified on the surface of the base material strip, so as to form a melt merging; with the base metal melt being gradually solidified under the cooling effect of the base material strip having low temperature and the mould, a composite slab (B) is formed, wherein a single base material strip that passes through the inner wall of one side of the mould forms a single-sided composite slab, two base material strips that passes through the inner walls of two sides of the mould form a double-sided composite slab;

4) the composite slab (B) formed from the mould passes through the mould from below and enters into secondary cooling section (10), where cooling water is sprayed on the upper and lower surfaces of the composite slab to further solidify the incompletely solidified composite slab, meanwhile the rapid cooling prevents the crystal grains generated by surface solidification from growing and coarsening;

5) the cooled composite slab (B) is leveled by ski pass roll (11) and forwarded into rolling mill (12) to be rolled into composite strip (C) having thickness ranging from 0.5 mm to 100 mm; during the rolling process, the clad interface of the composite strip is further compressed and deformed at high temperature, the microstructure of the clad interface structure recovers and recrystallizes, a grain growth and element diffusion under high temperature promotes the recombination of the interface;

6) the rolled composite strip (C) is cooled on-line at on-line cooling equipment (13) according to the desired product performance, the on-line cooling rate ranges from 1-60° C./s, and the finish cooling temperature ranges from 50-600° C. depending on the thickness of the product;

7) the composite strip (C) cooled above is transported to leveler (14) for leveling, the leveled composite strip is cut in fixed length by a cut-to-length shear (15) or is coiled by a coiler (16).

The device and method for manufacturing metal clad plates in way of continuous casting and rolling according to the present invention can produce the following effects:

1) The device and method for manufacturing metal clad plates in way of continuous casting and rolling provided by the present invention, combines the continuous casting, rolling and heat treatment methods used for single material production with the continuous and large-scale production method of composite strip, greatly improves the production efficiency of composite plates;

2) The device and method for manufacturing metal clad plates in way of continuous casting and rolling provided by the present invention, can be used to produce single-sided or double-sided composite plates with different thickness specifications, wherein the base material or the composited material can be selected in a wide range, including carbon steel, stainless steel, special alloy steel, titanium, copper and the like;

3) The device and method for manufacturing metal clad plates in way of continuous casting and rolling provided by the present invention, realizes the production of composite plates by continuous casting and rolling, and reduces energy consumption and costs.

FIGURE DESCRIPTION

FIG. 1 shows a diagram of the device of a device and method for manufacturing metal clad plates in way of continuous casting and rolling according to the present invention.

1—uncoiler, 2—pinch roller, 3—shot blasting machine, 4—welding equipment, 5—welding pinch roller, 6—induction heating apparatus, 7—guiding roller, 8—mould, 9—tundish, 10—secondary cooling section, 11—ski pass roll, 12—rolling mill, 13—on-line cooling equipment, 14—leveler, 15—cut-to-length shear, 16—coiler, A—base material strip, B—composite slab, C—composite strip.

DETAILED DESCRIPTION OF THE EMBODIMENTS

In the following, with reference to the drawings and embodiments, a device and method for manufacturing metal clad plates in way of continuous casting and rolling provided by the present invention will be further described.

Example 1 Double-Sided Composite Plate

1) Uncoiling 20 mm thick 316L stainless steel strip used as cover layer with uncoiler and sending it to shot blasting machine where its surface will be cleaned through pinch roller. The shot blasted 316L stainless steel strip enters into welding equipment, the tail of the previous roll of the 316L stainless steel strip and the head of the next roll of the 316L stainless steel strip are welded, so the 316L stainless steel strip used as cover layer material will be continuous supplied;
2) The welded 316L stainless steel strip used as cover layer is transported to induction heating apparatus to be heated through welding pinch roller, wherein the induction heating apparatus is filled with nitrogen for protection, the heating temperature is 850° C., the heating speed is 10° C./s;
3) The heated 316L stainless steel used as cover layer passes through the mould along the inner wall of the wide side of the mould at a speed of 3 m/min via guiding roller. The distance of the wide side of the mould is 300 mm Molten Q235B carbon steel is poured from the tundish into the mould through a nozzle, the pouring temperature is 1610° C. The surface of the mould is blown with argon to reduce the oxidation of molten steel. Molten Q235B carbon steel contacts with the surface of the 316L stainless steel, causing slightly melt on the surface of the 316L stainless steel, so as to form a preliminary melt merging between the cover layer and the base layer. Thus, the double-sided composite slab with the Q235B carbon steel as the base layer and the 316L stainless steel as the cover layer is formed, and its thickness is 300 mm (20+260+20 mm);
4) The double-sided composite slab formed in the mould passes through the mould and enters into secondary cooling section, where cooling water is sprayed on the upper and lower surfaces of the composite slab to further solidify the incompletely solidified composite slab, meanwhile rapid cooling prevents the crystal grains generated by surface solidification from growing and coarsening;
5) The cooled composite slab is transported to rolling mill at 1120° C. to be rolled into a double-sided composite plate with a thickness of 30 mm (2+26+2 mm), and the final rolling temperature is 1000° C. The rolled composite plate is cooled on-line, the start cooling temperature is 950° C., the final cooling temperature is 540° C., and the cooling rate is 25° C./s;
6) The cooled composite strip is transported to leveler for leveling, and the leveled composite strip is cut to fixed length by a cut-to-length shear.

Example 2 Single-Sided Composite Plate

1) A 30 mm thick 304 stainless steel strip used as the cover layer is transported to shot blasting machine where its surface will be cleaned through pinch roller. The shot blasted 304 stainless steel strip enters into welding equipment, the tail of the previous roll of the 304 stainless steel strip and the head of the next roll of the 304 stainless steel strip are welded, so the 304 stainless steel strip used as cover layer will be continuous supplied;
2) The welded 304 stainless steel strip used as cover layer is transported to induction heating apparatus to be heated through welding pinch roller, wherein the induction heating apparatus is filled with nitrogen for protection, the heating temperature is 750° C., the heating speed is 8° C./s;
3) The heated 304 stainless steel used as cover layer passes through the mould along the inner wall of the wide side of the mould at a speed of 1.5 m/min via guiding roller. The distance of the wide side of the mould is 280 mm Molten AH36 carbon steel is poured from the tundish into the mould through a nozzle, the pouring temperature is 1600° C. The surface of the mould is blown with argon to reduce the oxidation of molten steel. The molten steel is gradually solidified under the cooling effect of the cool steel strip used as the cover layer, the wide side and the narrow side of the mould. Molten AH36 carbon steel contacts with the surface of the 304 stainless steel, causing slightly melt on the surface of the 304 stainless steel, so as to form a preliminary melt merging between the cover layer and the base layer. Thus, the single-sided composite slab with the AH36 carbon steel as the base layer and the 304 stainless steel as the cover layer is formed, and its thickness is 280 mm (30+250 mm);
4) The single-sided composite slab formed in the mould passes through the mould and enters into secondary cooling section, where cooling water is sprayed on the upper and lower surfaces of the composite slab to further solidify the incompletely solidified composite slab, meanwhile rapid cooling prevents the crystal grains generated by surface solidification from growing and coarsening;
5) The cooled composite slab is transported to rolling mill at 1050° C. to be rolled into a single-sided composite plate with a thickness of 14 mm (1.5+12.5 mm), and the final rolling temperature is 980° C. The rolled composite plate is cooled on-line, the start cooling temperature is 920° C., the final cooling temperature is 400° C., and the cooling rate is 30° C./s;

6) The cooled composite strip is transported to leveler for leveling, and the leveled composite strip is cut to fixed length by a cut-to-length shear.

The device and method for manufacturing metal clad plates in way of continuous casting and rolling provided by the present invention, combines the continuous casting, rolling and heat treatment methods used for single material production with the continuous and large-scale production method of composite strip, greatly improves the production efficiency of composite plates. The present invention can be used for producing single-sided or double-sided composite plates with different thickness specifications, wherein the base material or the composited material can be selected in a wide range, including carbon steel, stainless steel, special alloy steel, titanium, copper and the like. The invention realizes the production of composite plates by continuous casting and rolling, and reduces energy consumption and costs.

We claim:

1. A device for manufacturing metal clad plates in way of continuous casting and rolling, the device comprising first and second base material supplying equipment lines each including an uncoiler, a pinch roller, a shot blasting machine, a welding equipment, a welding pinch roller, an induction heating apparatus, and a guiding roller; wherein, a first base material strip (A) is transported through the uncoiler, the pinch roller, the shot blasting machine, the welding equipment, the welding pinch roller, the induction heating apparatus and the guiding roller of the first base material supplying equipment line; a second base material strip is transported through the uncoiler, the pinch roller, the shot blasting machine, the welding equipment, the welding pinch roller, the induction heating apparatus and the guiding roller of the second base material supplying equipment line, the first and second material strips are transported to a mould where the first and second base material strips and a molten steel are merged; the first and second base material strips enter the mould from above and pass through from below along inner walls of two sides of the mould, wherein the inner walls of two sides of the mould being sealed with side seal plates; a tundish for casting the molten steel is provided above the mould; the molten steel flows from the tundish into the mould and comes into contact with the first and second base material strips in the mould, so that a preliminary melt merging takes place; after the preliminary melt merging, the first and second base material strips (A) form composite slabs (B) and pass through the mould from below, and are cooled at a secondary cooling section with a cooling-spray located at an outlet of a lower part of the mould; a ski pass roll is provided after the secondary cooling section, and after the ski pass roll provided is a rolling mill for making composite slabs into composite strips (C) with a designed different size and specification; an on-line cooling equipment for the composite strips is provided after the rolling mill, a leveler is provided at an exit of the on-line cooling equipment; and the composite strips levelled by the leveler are then cut to a desired fixed length by a cut-to-length shear or coiled by a coiler.

2. A process for manufacturing metal clad plates in way of continuous casting and rolling, the method comprising:

transporting a first base material strip through an uncoiler, a pinch roller, a shot blasting machine, a welding equipment, a welding pinch roller, an induction heating apparatus, and a guiding roller of a first base material supplying equipment line;

transporting a second base material strip through an uncoiler, a pinch roller, a shot blasting machine, a welding equipment, a welding pinch roller, an induction heating apparatus and a guiding roller of a second base material supplying equipment line;

transporting the first and second base material strips to a mould where the first and second base material strips and a molten steel are merged, wherein the first and second base material strips enter into the mould from above and pass through from below along inner walls of two sides of the mould, the inner walls of two sides of the mould are sealed with side seal plates, a tundish for casting the molten step is provided above the mould, the molten steel flows from the tundish into the mould and comes into with the first and second base material strips in the mould, that a preliminary melt merging takes place, and, after the preliminary melt merging, the first and second base material strips form composite slabs and pass through the mould from below;

cooling the composite slabs at a secondary cooling section with a cooling-spray located at an outlet of a lower part of the mould;

leveling the composite slabs by a ski pass roll provided after the secondary cooling section;

forwarding the composite slabs into a rolling mill provided after the secondary cooling section and rolling the composite slabs into composite strips with a designed different size and specification;

cooling the composite strips at an on-line cooling equipment provided after the rolling mill;

leveling the composite strips at a leveler provided at an exist of the on-line cooling equipment; and cutting the composite strips to a desired fixed length by a cut-to-length shear or coiling the composite strips by a coiler.

3. The device of claim 1, wherein the first base material strip is transported through the uncoiler, the pinch roller, the shot blasting machine, the welding equipment, the welding pinch roller, the induction heating apparatus and the guiding roller of the first base material supplying equipment line in that sequential order, and the second base material strip is transported through the uncoiler, the pinch roller, the shot blasting machine, the welding equipment, the welding pinch roller, the induction heating apparatus and the guiding roller of the second base material supplying equipment line in that sequential order.

4. The device of claim 1, wherein the induction heating apparatus is filled with an atmosphere comprising nitrogen.

5. The device of claim 1, wherein the molten steel flows from the tundish into the mould with argon blowing on a surface of the molten steel.

* * * * *